US010138112B2

(12) United States Patent
Grice et al.

(10) Patent No.: US 10,138,112 B2
(45) Date of Patent: Nov. 27, 2018

(54) SMART FUEL DISPENSER FOR EFFICIENT FUEL DELIVERY

(71) Applicant: Lenovo Enterprise Solutions (Singapore) Pte. Ltd., Singapore (SG)

(72) Inventors: Jonathan Keener Grice, Raleigh, NC (US); Emil Paul Parker, Youngsville, NC (US); Alper Sitki Gurdal, Raleigh, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 56 days.

(21) Appl. No.: 15/215,856

(22) Filed: Jul. 21, 2016

(65) Prior Publication Data

US 2018/0022596 A1 Jan. 25, 2018

(51) Int. Cl.

| | |
|---|---|
| ***B65B 1/30*** | (2006.01) |
| ***B67D 7/34*** | (2010.01) |
| ***B67D 7/04*** | (2010.01) |
| ***B67D 7/30*** | (2010.01) |

(52) U.S. Cl.
CPC ..... *B67D 7/348* (2013.01); *B67D 7/04* (2013.01); *B67D 7/302* (2013.01)

(58) Field of Classification Search
CPC ..... B60L 11/1824; B60S 5/02; B67D 7/04; B67D 7/22; B67D 7/302; B67D 7/348; B67D 7/42; B67D 7/845
USPC ..... 141/2, 94
See application file for complete search history.

(56) References Cited

U.S. PATENT DOCUMENTS

| | | | | |
|---|---|---|---|---|
| 5,913,180 | A * | 6/1999 | Ryan | B67D 7/145 235/375 |
| 6,237,647 | B1 * | 5/2001 | Pong | B67D 7/0401 141/231 |
| 6,374,870 | B1 * | 4/2002 | Muller | B67D 7/067 141/198 |
| 7,619,319 | B1 * | 11/2009 | Hunter | B60L 11/1816 290/4 R |
| 2011/0000579 | A1 * | 1/2011 | Allinson | B67D 7/0498 141/9 |
| 2012/0303397 | A1 * | 11/2012 | Prosser | H02J 7/0054 705/7.12 |
| 2013/0240080 | A1 * | 9/2013 | Pick | B67D 7/04 141/4 |
| 2014/0311619 | A1 * | 10/2014 | Herp | B67D 7/426 141/1 |

* cited by examiner

*Primary Examiner* — Jason K Niesz
(74) *Attorney, Agent, or Firm* — Jeffrey L. Streets

(57) ABSTRACT

A fuel dispenser may include a transceiver for wireless communication with a transceiver on a vehicle in order to receive vehicle information about a vehicle in response to a transceiver on the vehicle coming into a wireless communication range of the transceiver of the fuel dispenser. The vehicle information may be used to identify at least one fuel type that is suitable for the vehicle and the fuel dispenser may be prevented from dispensing a fuel type other than the at least one identified fuel type. The vehicle may also request a specific amount of fuel. A fuel transaction is complete when the amount of fuel dispensed reaches the requested amount or when an automatic shut-off mechanism is triggered.

20 Claims, 4 Drawing Sheets

SMART FUEL DISPENSER FOR EFFICIENT FUEL DELIVERY

BACKGROUND

Field of the Invention

The present invention relates to systems and methods for transferring fuel into a fuel container, such as the fuel tank of a vehicle.

Background of the Related Art

Vehicles of various types may be powered by an internal combustion engine that consumes a fuel, such as gasoline or diesel fuel. Each vehicle carries a supply of fuel in a fuel tank, which must be replenished from time-to-time with use of the vehicle. Refueling of the vehicle typically occurs at a gas station having one or more fuel dispensers. A vehicle operator may park their vehicle adjacent to a fuel dispenser and initiate refueling. The operator may either manually control the fuel flow from a nozzle into the fuel tank or rely upon an automatic shutoff mechanism within the nozzle. While the automatic shutoff mechanism is convenient and widely used, it can sometimes trigger a shut-off of the fuel dispenser prior to the fuel tank being full. In fact, it is sometimes necessary for the operator to repeatedly restart the dispensing of fuel from the nozzle. Since it may not be possible to distinguish a false shut-off from a valid shut-off due to a full fuel tank, repeated restarting of the fuel flow can lead to overfilling the fuel tank with the excess fuel spilling onto the vehicle or pavement under the vehicle. A fuel spill can cause damage to health, property and the environment.

The selection of a fuel type to be dispensed into the fuel tank of a vehicle is a matter that is substantially controlled by the vehicle operator. Since a fuel dispenser may have the capability of dispensing various grades of gasoline and diesel, it is up to the operator to determine an appropriate fuel type for the vehicle. A careless, distracted or uninformed operator can accidentally cause extensive damage to their vehicle by using the wrong fuel type.

BRIEF SUMMARY

One embodiment of the present invention provides an apparatus comprising a fuel dispenser including a fuel dispenser controller and a transceiver in electronic communication with the fuel dispenser controller, wherein the fuel dispenser controller is configured to receive information about a vehicle in response to a transceiver on the vehicle coming into a wireless communication range of the transceiver of the fuel dispenser.

Another embodiment of the present invention provides a method comprising receiving, by a fuel dispenser having a controller, information about a vehicle in response to the vehicle coming into a communication range of the controller, using the information to identify at least one fuel type that is suitable for the vehicle, and preventing the fuel dispenser from dispensing a fuel type other than the at least one identified fuel type.

Yet another embodiment of the present invention provides a computer program product for controlling operation of a fuel dispenser, the computer program product comprising a non-transitory computer readable storage medium having program instructions embodied therewith, wherein the program instructions are executable by a processor to cause the processor to perform a method. The method comprises receiving, by a fuel dispenser having a controller, information about a vehicle in response to the vehicle coming into a communication range of the controller, using the information to identify at least one fuel type that is suitable for the vehicle, and preventing the fuel dispenser from dispensing a fuel type other than the at least one identified fuel type.

DETAILED DESCRIPTION

Figure 1:
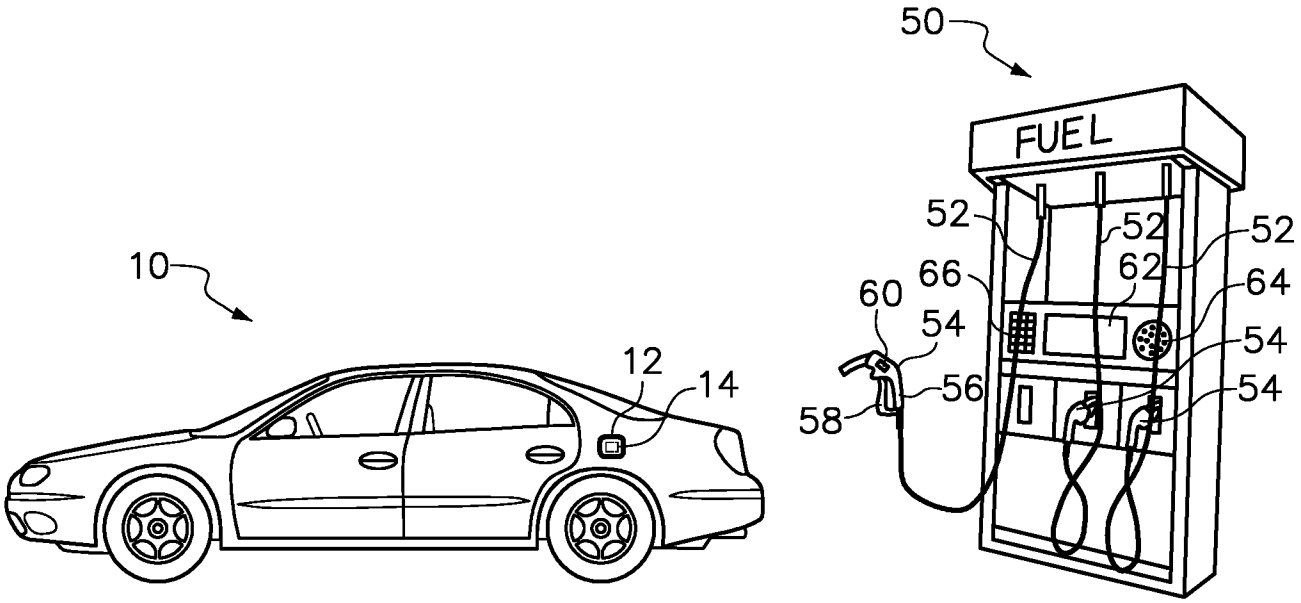
FIG. 1 is an illustration of a vehicle located adjacent to a fuel dispenser.

One embodiment of the present invention provides an apparatus comprising a fuel dispenser including a fuel dispenser controller and a transceiver in electronic communication with the fuel dispenser controller, wherein the fuel dispenser controller is configured to receive information about a vehicle in response to a transceiver on the vehicle coming into a wireless communication range of the transceiver of the fuel dispenser.

A basic fuel dispenser is a common fixture of a fueling station, also referred to as a filling station or gas station, where vehicle operators can take their vehicles to refill their fuel tanks. Accordingly, the fuel dispensers of the present invention may include any or all standard components of a fuel dispenser. For example, a fuel dispenser may include a fuel pump that controllably delivers a selected liquid fuel through a flexible hose to a fuel dispenser nozzle having an automatic shutoff mechanism. Furthermore, the fuel dispenser may include multiple hoses and fuel dispenser nozzles, where one hose and one fuel dispenser nozzle is dedicated to each of a plurality of fuel types available from the fuel dispenser. For example, one commercially available fuel dispenser may have a separate hose and fuel dispenser nozzle for regular unleaded gasoline, premium unleaded gasoline, supreme unleaded gasoline, and diesel. Each fuel dispenser nozzle may have a separate transceiver that is in electronic communication with the fuel dispenser controller. In the present disclosure, the term "fuel type" may refer to any fuel that is sold as a distinct product, even though the fuel may differ only in one or more characteristic, such as its octane rating or additive content. The term "vehicles" may include, without limitation, automobiles, airplanes, boats, and military vehicles.

The transceivers may communicate using a communication protocol selected from near-field communication (NFC), active or passive radio frequency identification (RFID), and short range wireless (such as Bluetooth) without limitation to other standard or proprietary communication protocols now in use or developed in the future. In one example, the transceiver on the fuel dispenser is a near-field communication transceiver secured to a fuel dispenser nozzle and the transceiver on the vehicle is a near-field communication transceiver secured to the vehicle behind a fuel door of the vehicle.

Another embodiment of the present invention provides a system that comprises both the fuel dispenser and the vehicle. According to various embodiments, the fuel dispenser may be enabled with a transceiver that communicates with a fuel dispenser controller, which has access to memory and a user interface. Similarly, the vehicle may be enabled with a transceiver that communicates with a vehicle controller, which has access to memory and a user interface. Either or both controllers may take the form of a computer having a processor for executing program instructions to carry out one or more methods of the present invention. Modern fuel dispensers and vehicles already include suitable computer hardware that may be used to execute program instructions that, in combination with the transceivers, may perform embodiments of the present invention.

Furthermore, the fuel dispensing systems and methods may be completely compatible with existing technology ("backward compatible"). For example, in a situation where one or both of the vehicle and fuel dispenser have not been upgraded to include a transceiver or controller that is programmed according to embodiments of the present invention, the fueling process would simply be carried out manually.

Another embodiment of the present invention provides a method comprising receiving, by a fuel dispenser having a controller, information about a vehicle in response to the vehicle coming into a communication range of the controller, using the information to identify at least one fuel type that is suitable for the vehicle, and preventing the fuel dispenser from dispensing a fuel type other than the at least one identified fuel type.

In one embodiment, the method may further comprise the fuel dispenser controller receiving a fuel amount requested by the vehicle, and the fuel dispenser controller setting the requested fuel amount as a limit on the amount of fuel to be dispensing to the vehicle. Accordingly, the vehicle may make its own determination about an amount of fuel to take on. Such a determination may be made in consideration of a fuel tank capacity, a current fuel level, a destination stored by a navigation program, a fuel efficiency, and the like. For example, the vehicle may have a vehicle controller or computer that stores the fuel tank capacity in memory and is in communication with fuel level sensors to calculate a current amount of fuel and an amount of fuel that would fill the fuel tank. In an alternative example, the vehicle controller may store a current destination input by the operator and have access to map data and a current location allowing a travel distance to be determined. With access the historical fuel efficiency data for the vehicle, the vehicle controller may further determine a total amount of fuel necessary to reach the destination, and determine a requested amount of fuel to be dispensed as the difference between the total amount and the current amount of fuel in the fuel tank. After communicating the requested amount of fuel from the vehicle to the fuel dispenser, the method may further comprise dispensing fuel to the vehicle until either the amount of dispensed fuel is equal to the requested amount of fuel or an automatic shut-off is triggered.

Various embodiments of the present invention use the vehicle information received from the vehicle in order to identify at least one fuel type that is suitable for the vehicle. For example, the fuel dispenser controller may search a vehicle database to identify a suitable fuel type associated with the vehicle information. Optionally, the vehicle information may include a make and model of the vehicle, a unique vehicle identification number of the vehicle, or a stored user preference of fuel type. Furthermore, the vehicle information may include a current use of the vehicle, such as towing, heavy cargo, and high altitude, which might modify a typical selection of fuel type. In such an instance, the fuel dispenser controller may recommend a fuel type from among a plurality of suitable fuel types, wherein the recommended fuel type is optimal for the current use of the vehicle. For example, the fuel dispenser controller may recommend that a vehicle with a gasoline engine use a fuel type having a different octane rating than the vehicle would use in normal city or highway conditions. Still further, the vehicle information may include a request for a specific type of fuel and a specific amount of fuel.

In another embodiment, the method may further comprise the fuel dispenser controller selecting an advertisement from among multiple advertisements on the basis of one or more parameter of the vehicle information received via communication with the vehicle, and producing the selected advertisement on one or more output device of the fuel dispenser, wherein the one or more output device is selected from a display screen, speaker, or a combination thereof. For example, the one or more parameter of the vehicle information is selected from a make of the vehicle, a model of the vehicle, and an age of the vehicle. Accordingly, the selected advertisement may be specific to a particular make or model of vehicle, generally relevant to vehicles of a certain age range, or merely of potential relevance to operators of a particular vehicle type, style, price range, current use and the like. As a further specific example, a first automotive service or after-market product may be targeted to an owner of a new, high-end model car, and a second automotive service or after-market product may be targeted to an owner of an older model vehicle from another lower-end automobile manufacturer.

In a still further embodiment, the method may further comprise the fuel dispenser controller transmitting transaction details to the vehicle via the first and second transceivers in response to completion of a fuel dispensing transaction. Accordingly, transaction details such a price, fuel quantity, and fuel type may be provided to the vehicle for unspecified purposes.

Yet another embodiment of the present invention provides a computer program product for controlling operation of a fuel dispenser, the computer program product comprising a non-transitory computer readable storage medium having program instructions embodied therewith, wherein the program instructions are executable by a processor to cause the processor to perform a method. The method comprises receiving, by a fuel dispenser having a controller, information about a vehicle in response to the vehicle coming into a communication range of the controller, using the information to identify at least one fuel type that is suitable for the vehicle, and preventing the fuel dispenser from dispensing a fuel type other than the at least one identified fuel type.

The foregoing computer program products may further include program instructions for implementing or initiating any one or more aspects of the methods described herein. Accordingly, a separate description of the methods will not be duplicated in the context of a computer program product.

FIG. 1 is an illustration of a vehicle 10 located adjacent to a fuel dispenser 50. The vehicle 10 has a fuel door 12 on one side of the vehicle which opens to expose a gas cap. Removing the gas cap allows a fuel dispenser nozzle to be inserted into a fill tube leading to a fuel tank. The vehicle further includes a transceiver 14, which may be positioned behind the fuel door.

The fuel dispenser 50 is shown having three fuel hoses 52, each having its own fuel dispenser nozzle 54. The three fuel hoses 52 and nozzles 54 may be used to provide three separate fuel types, such as regular unleaded gasoline, premium unleaded gasoline, and diesel, respectively. Each nozzle 54 includes a handle 56 for gripping, a lever 58 for initiating fuel flow, an automatic shut-off mechanism (not shown), and a transceiver 60 for establishing wireless communication with the transceiver 14 on the vehicle 10. The fuel dispenser 50 further includes display screen 62, a speaker 64 and a keypad or buttons 66. Other elements of a user interface may be included, such as additional buttons and switches.

Figure 2:
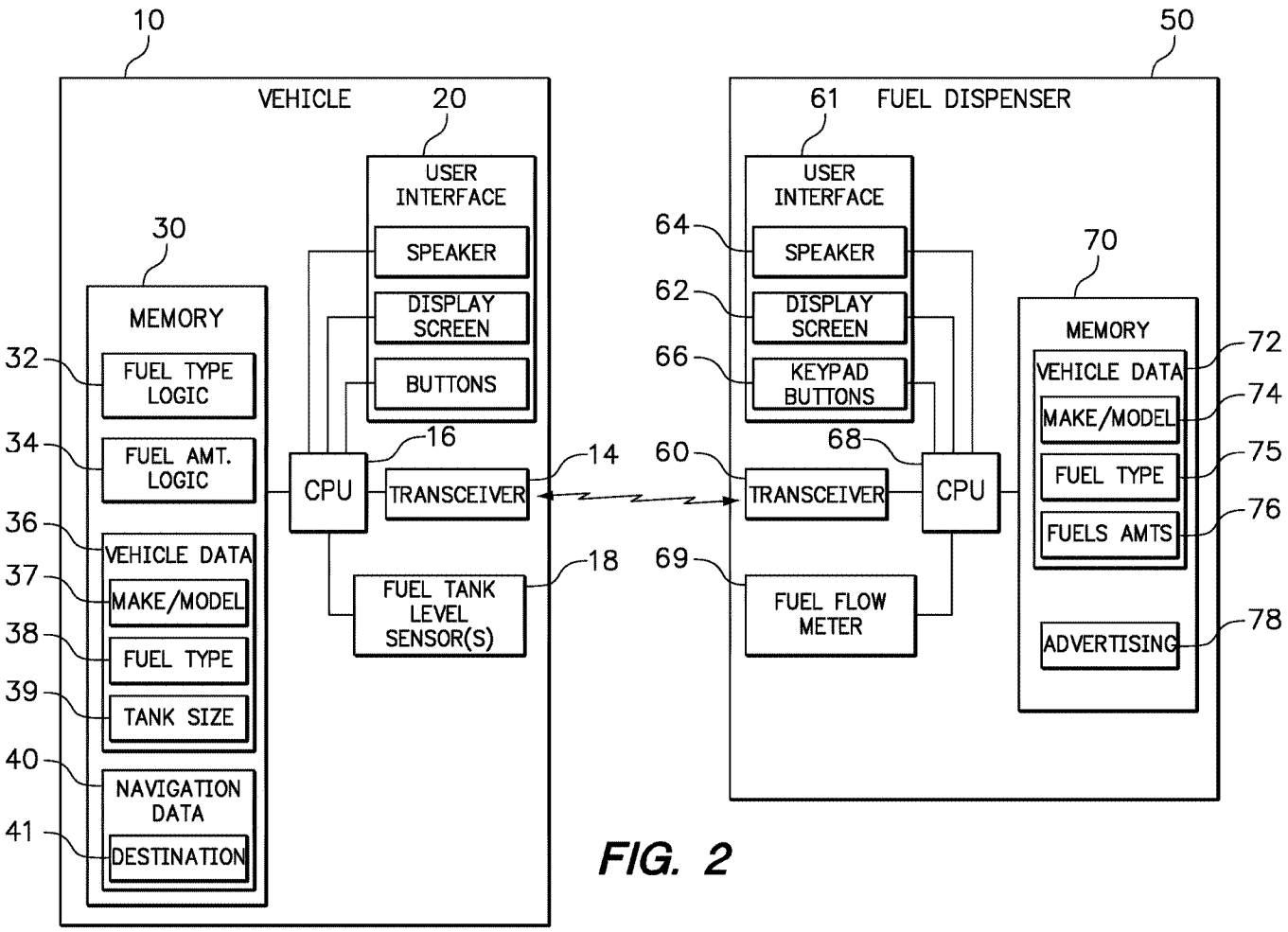
FIG. 2 is a block diagram of the vehicle in wireless communication with the fuel dispenser.

FIG. 2 is a block diagram of the vehicle 10 in wireless communication with the fuel dispenser 50. The vehicle 10 includes a vehicle controller in the form of a central processing unit (CPU) 16. The CPU 16 controls the vehicle transceiver 14 and the user interface 20, receives input from the fuel tank level sensor(s) 18, and has access to memory 30. In this example, the user interface 20 includes a speaker 22, a display screen 24 and one or more buttons 26, which may be installed in the dash of the vehicle for convenient use by the vehicle operator. Furthermore, the memory 30 may store various data and program instructions, such as fuel type logic 32, fuel amount logic 34, and vehicle data or information 36. In this illustration, the vehicle data 36 includes the vehicle make and model 37, the vehicle fuel type(s) 38, and the vehicle tank size or capacity 39. Still further, the memory 30 may store navigation data 40 including a current destination 41.

The fuel dispenser 50 includes a fuel dispenser controller in the form of a central processing unit (CPU) 68. The CPU 68 controls the fuel dispenser transceiver 60 and the user interface 61, receives input from the fuel flow meter 69, and has access to memory 70. The memory 70 stores vehicle data 72 covering many different vehicles that might refuel at the fuel dispenser 50. Such vehicle data 72 may include vehicle makes and models data 74, fuel types data 75, and fuel amounts data 76, which collectively may identify the fuel type(s) and fuel tank sizes for each make and model of vehicle identified in the vehicle data 72. Optionally, the memory 70 may further include various advertisements 78 for output on the user interface 61 in response to vehicle data received from the vehicle 10 via the transceivers 14, 16.

Figure 3:
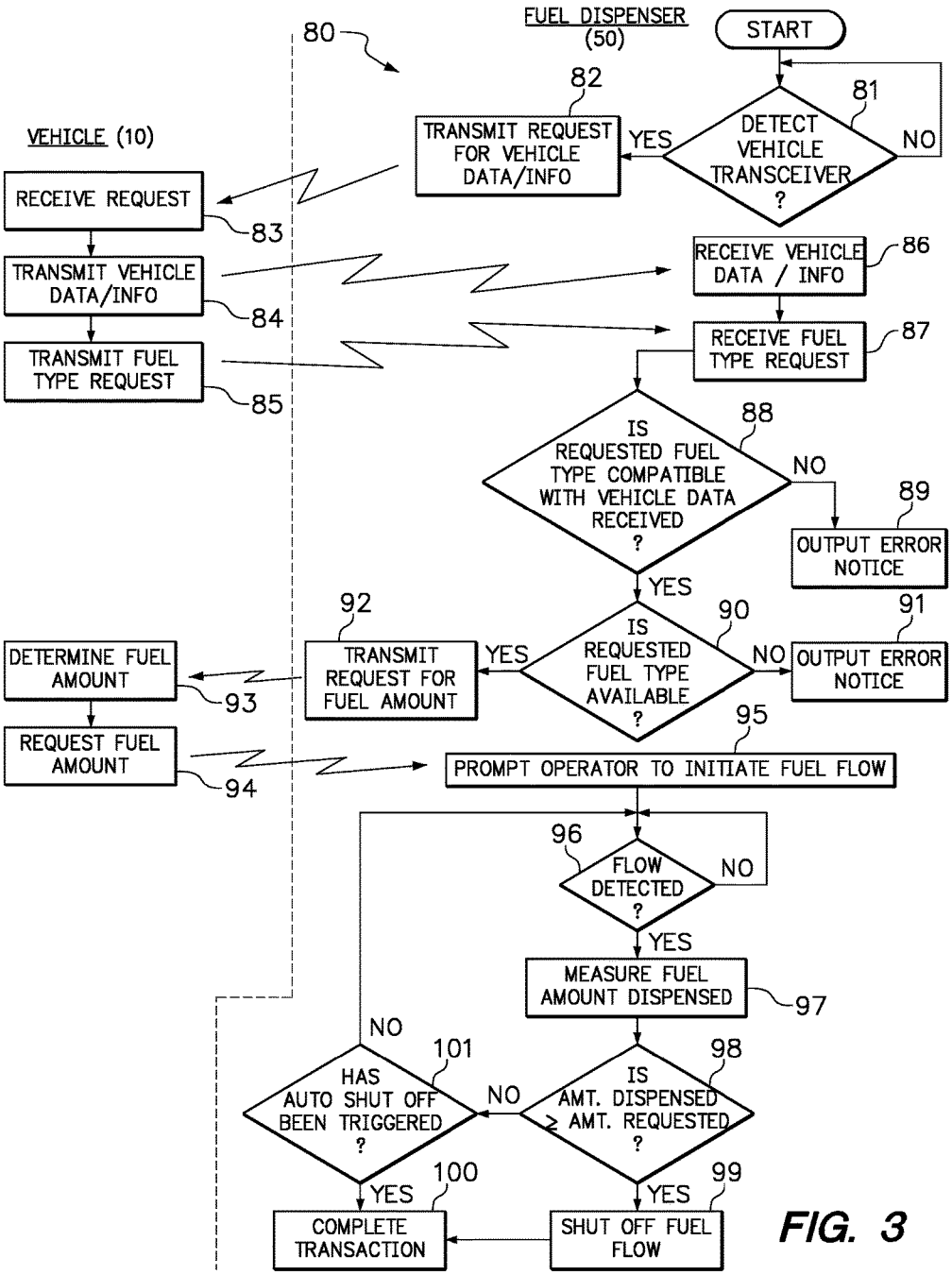
FIG. 3 is a flowchart of a method of performing a fuel transaction.

FIG. 3 is a flowchart of a method 80 of performing a fuel transaction, including various steps taken by the vehicle 10 and various steps taken by the fuel dispenser 50. The method is just one example of how the vehicle 10 and fuel dispenser 50 may communicate to carry out a fuel transaction, but it should be apparent that there are many other ways and variations to reach a similar result. The methods of the present invention are not limited to the example shown in FIG. 3. In the following description, reference numbers in parenthesis are references to elements shown in FIG. 2.

In step 81, the fuel dispenser (50) determines whether it can detect a vehicle transceiver (14). If no vehicle transceiver is detected, then the method does not proceed. However, if a vehicle transceiver is detected in step 81, then the fuel dispenser (50) transmits a request for vehicle data to the vehicle (10) in step 82. When the vehicle (10) receives the request in step 83, the vehicle then transmits its vehicle data or information (36) to the fuel dispenser (50) in step 84 and transmits its fuel type (38) request to the fuel dispenser in step 85. The fuel dispenser (50) receives the vehicle data or information (36) in step 86 and receives the fuel type (38) request in step 87.

In step 88, the fuel dispenser (50) determines whether the requested fuel type is compatible with the vehicle data received. If the requested fuel type is not compatible with the vehicle data received from the vehicle, then the fuel dispenser (50) outputs an error notice on its user interface (61) in step 89. However, if it is determined in step 88 that the requested fuel type is compatible with the vehicle data received from the vehicle, then the fuel dispenser (50) determines whether the requested fuel type is available in step 90. If the requested fuel type is not available, perhaps due to the requested fuel type being sold out or only being offered at certain fuel dispensers, then the fuel dispenser (50) outputs an error notice on its user interface (61) in step 91. However, if the requested fuel type is determined to be available in step 90, the fuel dispenser (50) transmits a request for a fuel amount to the vehicle (10) in step 92.

The vehicle determines a fuel amount in step 93 and requests the fuel amount in step 94. The fuel amount determination may, for example, include a calculation of an amount of fuel to fill the fuel tank of the vehicle or to reach a destination. One such calculation of an amount of fuel to fill the fuel tank may involve taking the difference between the tank size (39) and the current amount of fuel as measured by the fuel tank level sensor(s) (18). A calculation of an amount of fuel needed to reach a destination may be based on the destination (41) and some determination of a fuel efficiency, which may be stored in the vehicle data (36) or determined by a distance traveled according to the navigation data (40) and a change in the fuel tank level as indicated by the fuel tank level sensor(s) (18).

After the fuel dispenser (50) has received the requested fuel amount from the vehicle (10), the fuel dispenser (50) will prompt the vehicle operator to initiate fuel flow in step 95. Once fuel flow is detected in step 96, then the fuel dispenser measures the fuel amount being dispensed in step 97. If step 98 determines that the amount of fuel dispensed is greater than or equal to the amount of fuel requested, then step 99 shuts off the fuel flow and the fuel dispensing transaction is completed in step 100. However, if step 98 determines that the amount of fuel dispensed is not greater than or equal to the amount of fuel requested, then step 101 determines whether the automatic shut-off mechanism of the fuel dispenser nozzle has been triggered. If the automatic shut-off has not been triggered, then the method returns to step 96. If the automatic shut-off is determined to have been triggered in step 101, then the fuel transaction is completed in step 100.

Figure 4:
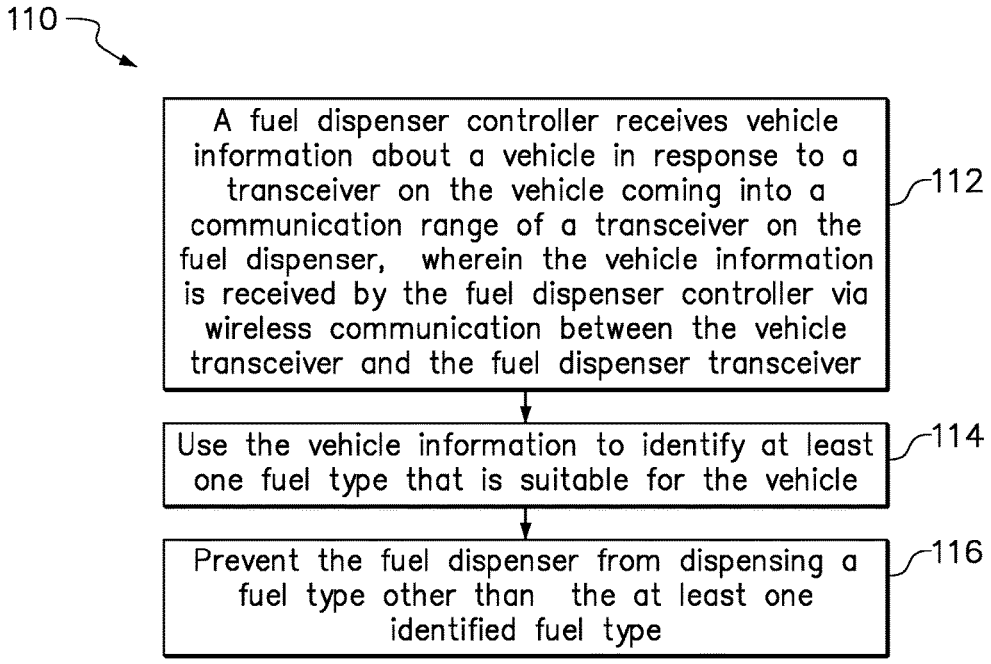
FIG. 4 is a flowchart of another method of performing a fuel transaction.

FIG. 4 is a flowchart of another method 110 of performing a fuel transaction. In step 112, a fuel dispenser controller receives vehicle information about a vehicle in response to a transceiver on the vehicle coming into a communication range of a transceiver on the fuel dispenser, wherein the vehicle information is received by the fuel dispenser controller via wireless communication between the vehicle transceiver and the transceiver on the fuel dispenser. In step 114, the method uses the vehicle information to identify at least one fuel type that is suitable for the vehicle. In step 116, the method prevents the fuel dispenser from dispensing a fuel type other than the at least one identified fuel type.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable storage medium(s) may be utilized. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. Furthermore, any program instruction or code that is embodied on such computer readable storage medium (including forms referred to as volatile memory) is, for the avoidance of doubt, considered "non-transitory".

Program code embodied on a computer readable storage medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention may be described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, and/or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored as non-transitory program instructions in a computer readable storage medium that can direct a computer, other programmable data processing apparatus, or other devices to function in a particular manner, such that the program instructions stored in the computer readable storage medium produce an article of manufacture including non-transitory program instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method, comprising:

receiving, by a fuel dispenser having a controller, information about a vehicle and a fuel amount requested by the vehicle in response to the vehicle coming into a communication range of the controller, wherein the controller receives the vehicle information via wireless communication between a transceiver secured to the vehicle and a transceiver on the fuel dispenser;

using the information to identify at least one fuel type that is suitable for the vehicle; and preventing the fuel dispenser from dispensing a fuel type other than the at least one identified fuel type to the vehicle;

setting the requested fuel amount as a limit on the amount of fuel that the fuel dispenser will dispense to the vehicle; and dispensing fuel to the vehicle until either the amount of dispensed fuel is equal to the requested amount of fuel or an automatic shut-off is triggered, wherein the dispensed fuel is one of the at least one fuel type identified to be suitable for the vehicle.

2. The method of claim 1, wherein the vehicle transceiver and the fuel dispenser transceiver communicate using a communication protocol selected from near-field communication, active radio frequency identification, passive radio frequency identification, and short range wireless.

3. The method of claim 1, wherein using the vehicle information to identify at least one fuel type that is suitable for the vehicle, includes searching a vehicle database to identify a suitable fuel type associated with the vehicle information.

4. The method of claim 3, wherein the vehicle information includes a make and model of the vehicle.

5. The method of claim 3, wherein the vehicle information includes a unique vehicle identification number of the vehicle.

6. The method of claim 1, wherein the vehicle information includes a request for a specific type of fuel.

7. The method of claim 1, wherein the vehicle information includes a current use of the vehicle selected from towing, heavy cargo, and high altitude; and the fuel dispenser controller recommending a fuel type from among the suitable fuel types that is preferred for the current use of the vehicle.

8. The method of claim 1, further comprising;

the fuel dispenser controller selecting an advertisement from among multiple advertisements on the basis of one or more parameter of the vehicle information received via communication with the vehicle; and producing the selected advertisement on one or more output device of the fuel dispenser, wherein the one or more output device is selected from a display screen, speaker, or a combination thereof.

9. The method of claim 8, wherein the one or more parameter of the vehicle information is selected from a make of the vehicle, a model of the vehicle, and an age of the vehicle.

10. The method of claim 1, further comprising:

the fuel dispenser controller using the fuel dispenser transceiver to transmit fuel dispensing transaction details to the vehicle via the vehicle transceiver in response to completion of the fuel dispensing transaction.

11. A computer program product for controlling operation of a fuel dispenser, the computer program product comprising a non-transitory computer readable storage medium having program instructions embodied therewith, wherein the program instructions are executable by a processor controlling the fuel dispenser to cause the processor to:

receive information about a vehicle and a fuel amount requested by the vehicle in response to the vehicle coming into a communication range of the fuel dispenser, wherein the processor receives the vehicle information via wireless communication between a transceiver secured to the vehicle and a transceiver on the fuel dispenser;

use the information to identify at least one fuel type that is suitable for the vehicle; and prevent the fuel dispenser from dispensing a fuel type other than the at least one identified fuel type to the vehicle;

set the requested fuel amount as a limit on the amount of fuel that the fuel dispenser will dispense to the vehicle; and dispense fuel to the vehicle until either the amount of dispensed fuel is equal to the requested amount of fuel or an automatic shut-off is triggered, wherein the dispensed fuel is one of the at least one fuel type identified to be suitable for the vehicle.

12. The computer program product of claim 11, wherein the vehicle transceiver and the fuel dispenser transceiver communicate using a communication protocol selected from near-field communication, active radio frequency identification, passive radio frequency identification, and short range wireless.

13. The computer program product of claim 11, wherein the program instructions executable by the processor to cause the processor to use the vehicle information to identify at least one fuel type that is suitable for the vehicle, include program instructions executable by the processor to cause the processor to search a vehicle database to identify a suitable fuel type associated with the vehicle information.

14. The computer program product of claim 13, wherein the vehicle information includes a make and model of the vehicle.

15. The computer program product of claim 13, wherein the vehicle information includes a unique vehicle identification number of the vehicle.

16. The computer program product of claim 11, wherein the vehicle information includes a request for a specific type of fuel.

17. The computer program product of claim 11, wherein the vehicle information includes a current use of the vehicle selected from towing, heavy cargo, and high altitude; and wherein the program instructions are further executable by the processor to cause the processor to recommend a fuel type from among the suitable fuel types that is preferred for the current use of the vehicle.

18. The computer program product of claim 11, where the program instructions are further executable by the processor to cause the processor to:

select an advertisement from among multiple advertisements on the basis of one or more parameter of the vehicle information received via communication with the vehicle; and produce the selected advertisement on one or more output device of the fuel dispenser, wherein the one or more output device is selected from a display screen, speaker, or a combination thereof.

19. The computer program product of claim 18, wherein the one or more parameter of the vehicle information is selected from a make of the vehicle, a model of the vehicle, and an age of the vehicle.

20. The computer program product of claim 11, where the program instructions are further executable by the processor to cause the processor to:

use the fuel dispenser transceiver to transmit fuel dispensing transaction details to the vehicle via the vehicle transceiver in response to completion of the fuel dispensing transaction.

* * * * *